United States Patent [19]

McClain et al.

[11] Patent Number: 4,990,056

[45] Date of Patent: Feb. 5, 1991

[54] STATOR VANE STAGE IN AXIAL FLOW COMPRESSOR

[75] Inventors: John C. McClain, Plainfield; Patrick D. Murphy; David S. Huelster, both of Indianapolis, all of Ind.

[73] Assignee: General Motors Corporation, Detroit, Mich.

[21] Appl. No.: 437,240

[22] Filed: Nov. 16, 1989

[51] Int. Cl.[5] ..... F01D 1/02; F04D 29/56

[52] U.S. Cl. ..... 415/160; 415/189; 415/209.4; 29/889.22

[58] Field of Search ..... 415/203.4, 149.1, 149.2, 415/190, 159, 160, 161, 208.1, 208.2, 208.3, 208.4, 208.5, 209.1, 209.2, 126, 127, 133, 134, 189; 29/889, 889.1, 889.22

[56] References Cited

U.S. PATENT DOCUMENTS

| | | | |
|---|---|---|---|
| 2,930,579 | 3/1960 | Boyd et al. | 415/160 |
| 3,075,744 | 1/1963 | Peterson | 253/78 |
| 3,079,128 | 2/1963 | Burge | 253/78 |
| 3,367,628 | 2/1968 | Fitton | 415/160 |
| 3,376,018 | 4/1968 | Williamson | 415/160 |
| 3,849,023 | 11/1974 | Klompas | 415/170 |
| 3,850,544 | 11/1974 | Ciokajlo | 415/149 |
| 4,558,986 | 12/1985 | Faltys | 415/150 |
| 4,604,030 | 8/1986 | Naudet | 415/126 |
| 4,706,354 | 11/1987 | Naudet et al. | 415/160 |
| 4,773,817 | 9/1988 | Stangalini et al. | 415/160 |
| 4,792,277 | 12/1988 | Dittberner et al. | 415/160 |
| 4,834,613 | 5/1989 | Hansen et al. | 415/160 |
| 4,856,962 | 8/1989 | McDow | 415/161 |
| 4,861,228 | 8/1989 | Todman | 415/160 |
| 4,883,404 | 11/1989 | Sherman | 415/160 |

FOREIGN PATENT DOCUMENTS 622767 5/1949 United Kingdom .

*Primary Examiner*—Edward K. Look
*Assistant Examiner*—Hoang Nguyen
*Attorney, Agent, or Firm*—Saul Schwartz

[57] ABSTRACT

A stator vane stage in a split-case, variable geometry axial flow compressor includes two 180-degree spoke-like arrays of stator vanes on upper and lower case halves of the compressor case and a pair of unitary, 180-degree arc shroud ring segments. Each stator vane has a pivot shaft at one end rotatably supported in a radial bore in the corresponding case half by a bushing and a cylindrical vane button at the other end. Each shroud ring segment has a corresponding plurality of cylindrical vane button sockets in an outer surface thereof which rotatably receives a corresponding vane button. The spoke-like array of the stator vanes rigidly positions the shroud ring segments relative to the compressor case. To assemble the shroud ring segments to the stator vanes, the shroud ring segments are first resiliently squeezed radially inward while the vane buttons are sequentially inserted into the corresponding vane button sockets and then released to spring back to their true 180-degree arc shapes in which they are captured on the stator vanes.

3 Claims, 3 Drawing Sheets

STATOR VANE STAGE IN AXIAL FLOW COMPRESSOR

FIELD OF THE INVENTION

This invention relates to stator vane stages in variable geometry axial flow compressors in gas turbine engines.

BACKGROUND OF THE INVENTION

In typical axial flow compressors in gas turbine engines, an annular airflow channel of progressively decreasing area is defined between a compressor case and a rotor in the case. Annular rotor blade stages motivate flow in the airflow channel and annular stator vane stages between the rotor blade stages redirect the airflow. In variable geometry axial flow compressors, the stator vanes are rotatable about spoke-like radial axes of the case. A hub-like shroud ring on the radially inner ends of the stator vanes defines the inner boundary of the airflow channel where it traverses the stator vane stage and supports seals which minimize leakage. In split-case axial flow compressors of fixed or variable geometry, where the case is split in a horizontal center-plane of the compressor for assembly purposes, the shroud ring is likewise split into a pair of 180-degree arc shroud ring segments.

Many arrangements have been proposed for attaching shroud ring segments to stator vanes in split-case, axial flow compressors. In a fixed geometry proposal, a pair unitary or one piece 180-degree arc shroud ring segments are attached to the stator vanes through hook-like projections on the inner ends of the vanes which seat in individual sockets in the unitary, shroud ring segments. In some prior variable geometry proposals, short arc-shaped shroud ring segments are assembled with corresponding groups of vanes and then unitized into 180-degree arc segments by end plates or like connecting devices. In other prior variable geometry proposals, 180-degree arc shroud ring segments are formed by bolting together two 180-degree arc end pieces. In the latter proposals, inner buttons or projections of the vanes are rotatably sandwiched between the bolted-together end pieces. While the bolted-together proposals do not require as many individual pieces as the multi-segment proposals, they are limited to relatively large compressors because the diameters of the shroud ring segments must be large enough to accommodate both the inner vane buttons and the bolts or other fasteners holding the end pieces together. A stator vane stage and method of making the same according to this invention features unitary or one-piece 180-degree arc shroud ring segments rotatably connected to variable geometry stator vanes.

SUMMARY OF THE INVENTION

This invention is a new and improved stator vane stage for a split-case, variable geometry axial flow compressor and a method of making the same. The stator vane stage according to this invention includes a plurality of stator vanes each having a pivot shaft at an outboard end for rotatably supporting the vane on an upper or lower half of the case and a cylindrical vane button at an inboard end which is rotatably received in a complementary cylindrical socket in a corresponding one of an upper or lower unitary, 180-degree arc shroud ring segment. Each half of the case has a 180-degree array of radial bores which receive bushings and respective ones of the vane pivot shafts whereby the stator vanes are rotatably supported on the upper and lower halves of the case in 180-degree spoke-like arrays. The spoke-like mounting of the stator vanes prevents radial or lateral bodily shiftable movement of the hub-like shroud ring segments so that additional support for the shroud ring segments is unnecessary. The method according to this invention of making the aforesaid stator vane stage includes the steps of forming a loose spoke-like array of stator vanes on the upper and lower halves of the case by fitting the vane pivot shafts in the radial bores without the bushings, flexing the unitary shroud ring segments by squeezing the ends thereof radially inward, sequentially fitting the vane button sockets over the vane buttons on the stator vanes, releasing the shroud ring segments to permit them to spring-back to their true semi-circular shapes, inserting the bushings between the vane pivot shafts and the corresponding radial bores in the case, and completing the shroud ring by bolting together the upper and lower halves of the case.

DESCRIPTION OF THE PREFERRED EMBODIMENT

Figure 1:
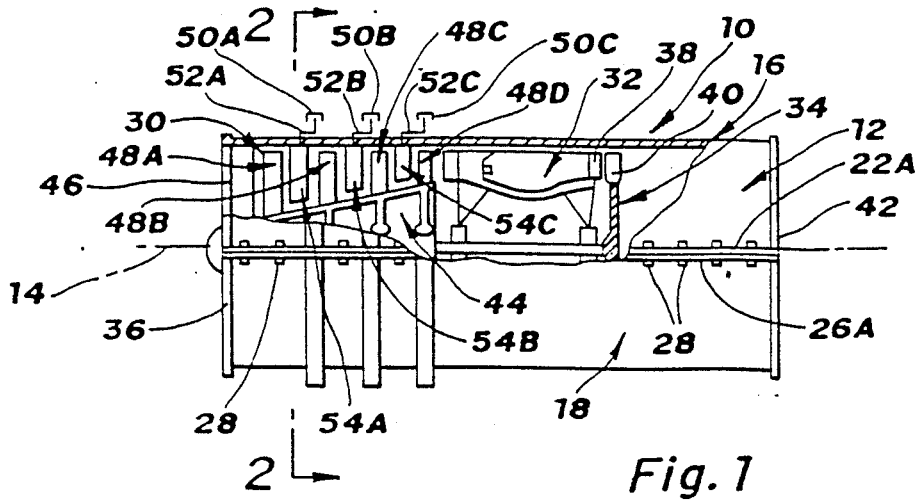
FIG. 1 is a schematic, partially broken-away side elevational view of a gas turbine engine having a split-case, variable geometry axial flow compressor including a stator vane stage according to this invention.
Figure 2:
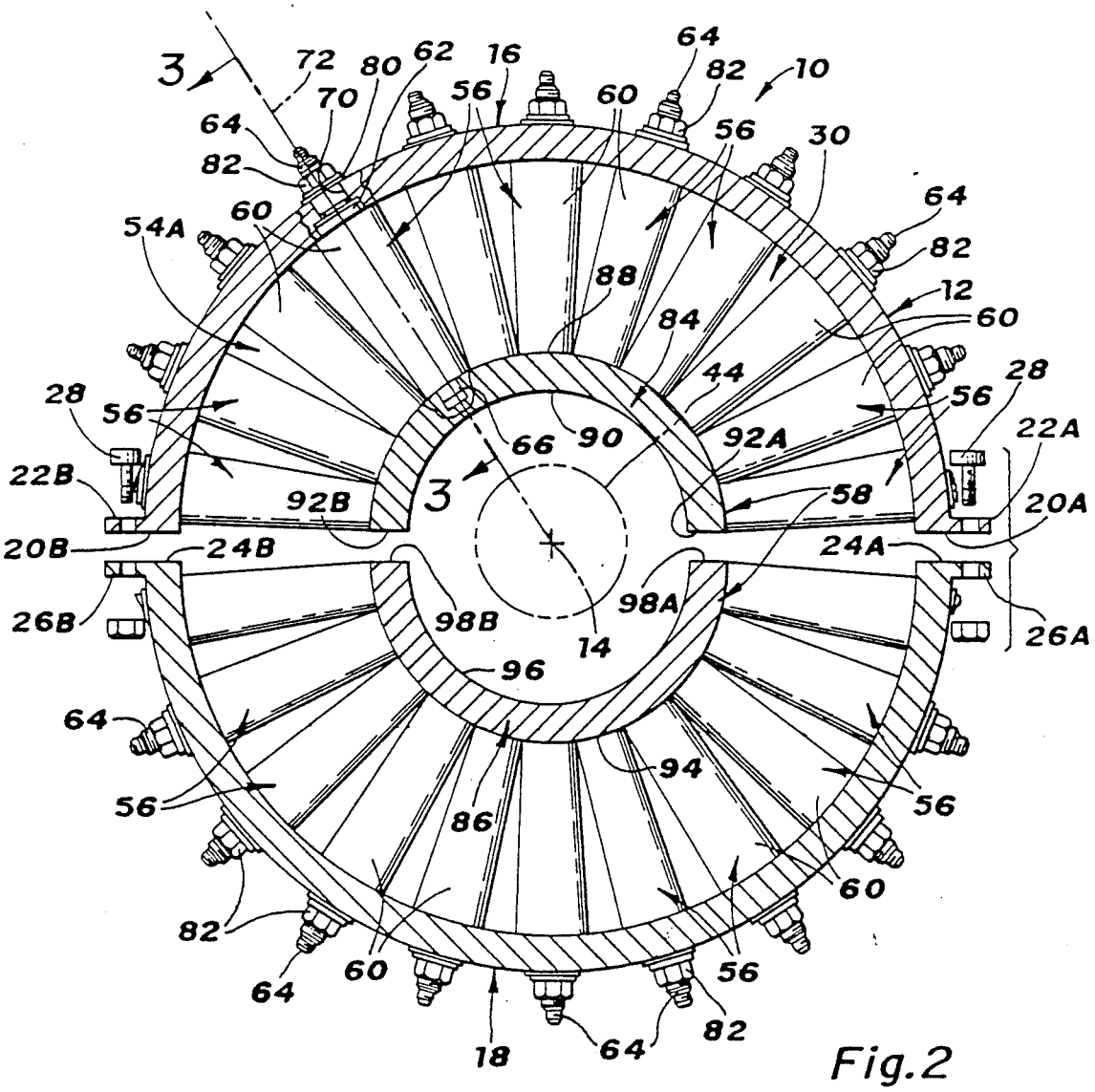
FIG. 2 is an enlarged partially exploded and partially broken-away sectional view taken generally along the plane indicated by lines 2—2 in FIG. 1.

Referring to FIGS. 1 and 2 of the drawings, a schematically illustrated gas turbine engine 10 includes a cylindrical case 12 having a longitudinal axis 14. The case is split in a horizontal center-plane containing the axis 14 and includes a first or upper case half 16 and a second or lower case half 18. The upper case half includes a pair of longitudinal edges 20A,B and a pair of integral flanges 22A,B at the edges 20A,B, respectively. The lower case half includes a corresponding pair of longitudinal edges 24A,B and a corresponding pair of integral flanges 26A,B at edges 24A,B. The upper and lower case halves abut at the edges 20A,24A and 20B,24B and are held together by a plurality of bolts 28 through appropriate holes in the flanges.

Within the case 12, the engine 10 includes a split-case, variable geometry axial flow compressor 30, an annular combustor 32, and a compressor turbine 34. Air enters the compressor at a front end 36 of the case and is delivered at a higher pressure to the combustor 32. Combustion of a fuel/air mixture in the combustor 32 generates a stream of hot gas motive fluid which expands through a nozzle ring 38 and through an annular stage of blades 40 of the turbine 34. The motive fluid is exhausted through a nozzle, not shown, and a back end 42 of the engine.

The variable geometry compressor 30 includes a frustoconical rotor 44 cooperating with the bolted-together upper and lower case halves 16,18 in defining an annular airflow channel 46 which progressively decreases in cross sectional area toward the combustor 32. The rotor 44 carries a plurality of airfoil-shaped blades in the channel 46 arrayed circumferentially in a plurality of annular stages 48A–D. A plurality of schematically illustrated unison rings 50A–C surround the case 12 and operate a plurality of schematically illustrated crankarms 52A–C. Each crank arm is connected to a corresponding one of a plurality of stator vanes arrayed in a plurality of annular stator vane stages 54A–C according to this invention between the rotor blade stages 48A–D.

Figure 3:
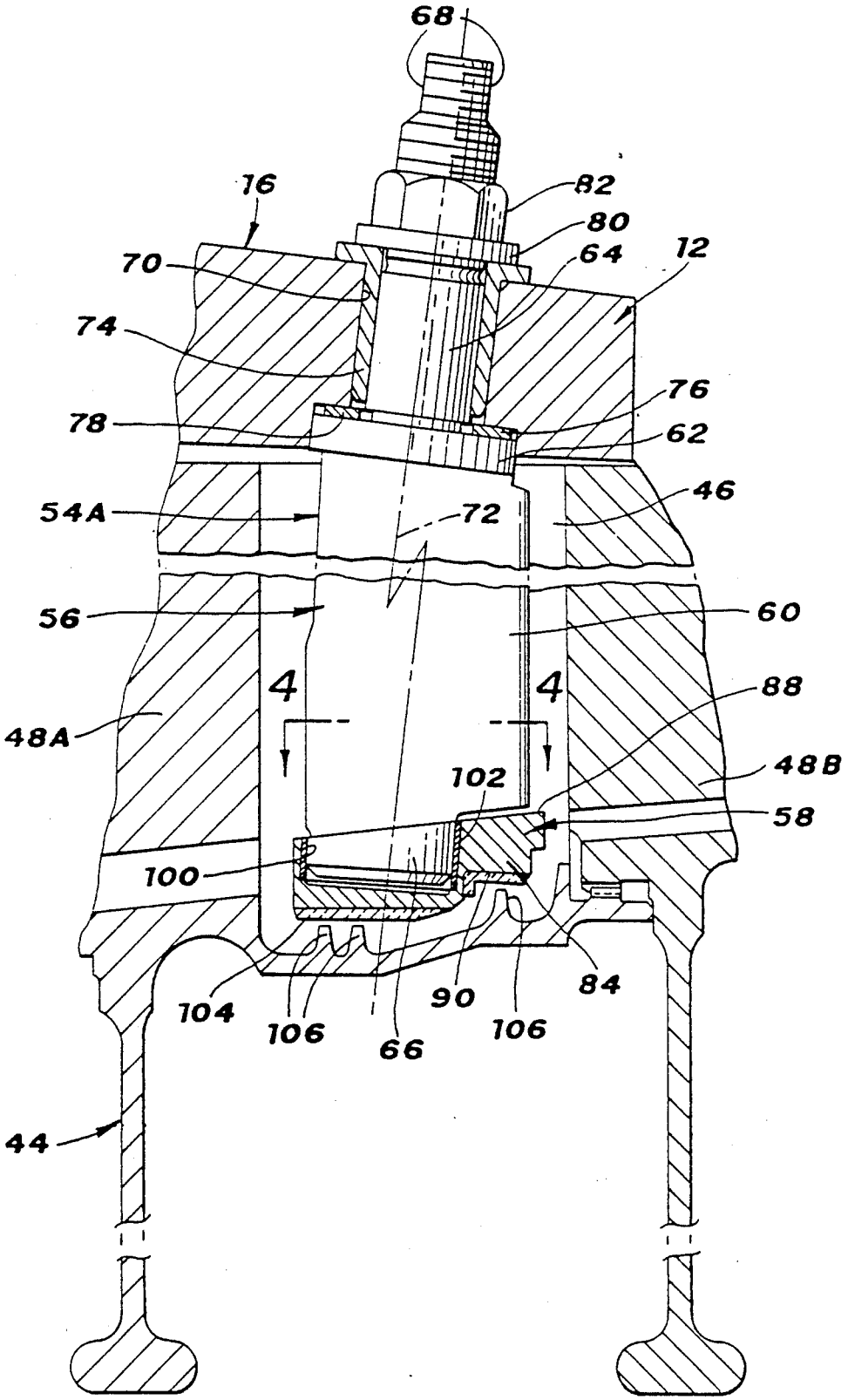
FIG. 3 is an enlarged sectional view taken generally along the plane indicated by lines 3—3 in FIG. 2.
Figure 4:
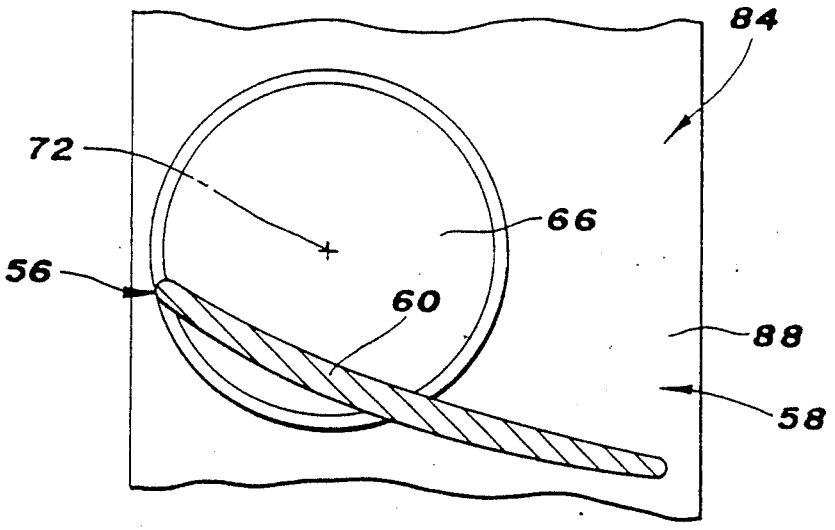
FIG. 4 is a sectional view taken generally along the plane indicated by lines 4—4 in FIG. 3.

The stator vane stage 54A is representative of the stages 54A–C and is illustrated in more detail in FIGS. 2–4. The stage 54A includes a plurality of stator vanes 56 arrayed annularly in wheel-spoke fashion between the bolted-together upper and lower case halves 16,18 and a split, hub-like shroud ring 58. Each stator vane 56 includes an airfoil 60, a disc-like bearing 62 at the top of the airfoil, a cylindrical pivot shaft 64 outboard of the bearing 62, and a cylindrical vane button 66 at the bottom of the airfoil. The outboard end or stem of each pivot shaft 64 is threaded and milled to define a pair of flats 68 for attaching a corresponding one of the crankarms 52A thereto for rotation as a unit therewith.

As seen best in FIGS. 2 and 3, each pivot shaft 64 is disposed in a bore 70 of greater diameter in one of the upper and lower case halves 16–18. Each bore 70 is located in a plane perpendicular to the axis 14 and is aligned on a corresponding one of a plurality of generally radial or wheel-spoke axes 72 of the case 12. A bushing 74 between each bore 70 and the corresponding pivot shaft 64 defines a journal bearing between the pivot shaft and the corresponding one of the upper and lower case halves. The vanes 56 are thus supported on the upper and lower case halves through their pivot shafts in 180-degree arrays and in wheel-spoke fashion for rotation about the radial axes 72.

A first washer 76 between the bearing 62 on each vane 56 and a corresponding spotface 78 on the upper and lower case halves cooperates with a second washer 80 and a nut 82 on the stem of each pivot shaft outside the upper and lower case halves in retaining the vanes on the case halves. When the unison ring 50A is shifted back and forth in the direction of longitudinal axis 14, the crankarms 52A attached to the stems of the pivot shafts 64 rotate the vanes 56 about their respective radial axes 72.

The split shroud ring 58 of the vane stage 54A includes a first or upper shroud ring segment 84 and a second or lower shroud ring segment 86. Each shroud ring segment is a unitary or one-piece 180-degree arc-shaped member having no bolts or other fasteners characteristic of earlier sandwich-type shroud ring segments.

The upper shroud ring segment 84 has an outer surface 88 facing the upper case half 16, an inner surface 90 opposite the outer surface 88, and a pair of planar ends 92A,B. The lower shroud ring segment 86 has an outer surface 94 facing the lower case half 18, an inner surface 96 opposite the outer surface 94, and a pair of planar ends 98A,B The planar ends 92A,98A and 92B,98B abut in the aforesaid horizontal center-plane of the case 12 when the upper and lower case halves 16,18 are bolted together.

As seen best in FIGS. 2–3, the cylindrical vane buttons 66 on the stator vanes 56 are received in respective ones of a plurality of vane button sockets 100 defined by cylindrical bores in the outer surfaces 88,94 of the upper and lower shroud ring segments 84,86. The sockets are centered on the radial axes 72 of the case and a plurality of bushings 102 rotatably journal the vane buttons in respective ones of the sockets 100 so that the stator vanes are rotatable relative to the upper and lower shroud ring segments about the radial axes 72. The inner surfaces 90,96 of the shroud ring segments carry with a seal material 104 which cooperates with a plurality of raised edges 106 on the rotor 44 in preventing airflow inside the shroud ring.

The stator vanes 56 function like the spokes of a wheel to rigidly support the shroud ring segments 84,86 on the upper and lower case halves of the compressor. When the upper and lower case halves are bolted together at the flanges 22A,26A and 22B,26B, the upper and lower shroud ring segments 84,86 abut at the planar ends 92A,98A and 92B,98B and cooperate to define the rigid shroud ring 58. The outer surfaces 88,94 of the shroud ring segments cooperate in defining the inside wall of the airflow channel 46 where the latter traverses the stator vane stage 54A.

Figure 5A:
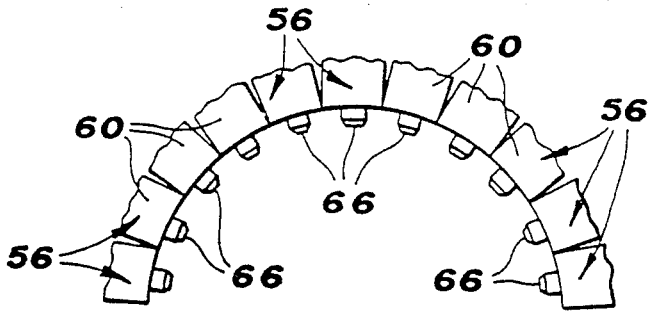
FIGS. 5A–5C schematically illustrate steps in the method according to this invention.

The method of forming the representative stator vane stage 54A according to this invention includes the steps of forming the radial bores 70 in the upper and lower case halves and forming the cylindrical vane button sockets 100 in the upper and lower unitary, 180-degree arc shroud ring segments 84,86 as described above. The method further includes the following steps. With the upper and lower case halves separated, the pivot shafts of each of the corresponding stator vanes 56 are fitted into respective ones of the radial bores 70 in the upper and lower case halves without the bushings 74, thereby to define on the upper and lower case halves loose 180-degree spoke-like arrays of stator vanes as partially shown in FIG. 5A.

Then, each of the upper and lower shroud ring segments 84,86 is pinched or squeezed radially to resiliently deflect the planar ends 92A–B toward each other and 98A–B toward each other. Turnbuckles, not shown, or similar devices may be used to effect and maintain the aforesaid resilient deflection of the shroud ring segments. In a stator vane stage having a shroud ring of on the order of 12 inches in diameter, the resilient deflection of the planar ends of the shroud ring segments toward each other may be about 0.4 inches.

Figure 5B:
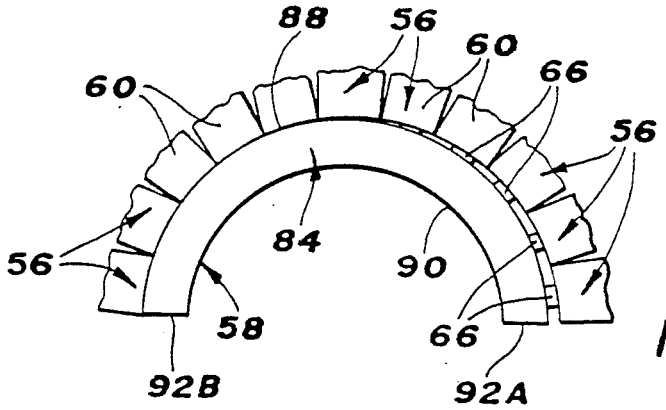
Figure 5C:
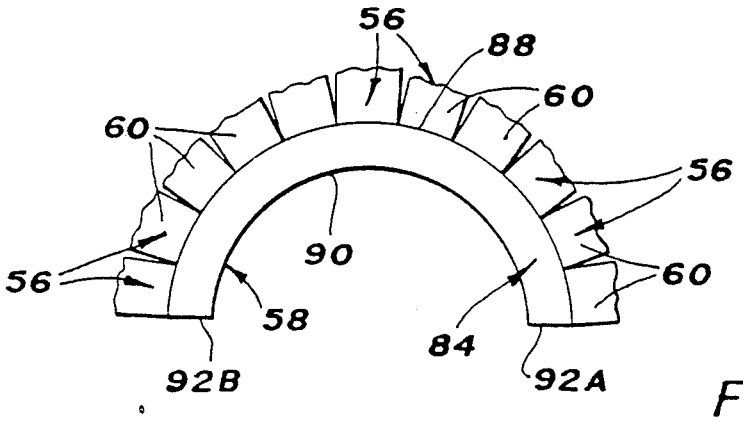

The upper and lower shroud ring segments 84,86 are assembled onto the corresponding ones of the stator vanes in the loose arrays by sequentially inserting each of the vane buttons 66 into corresponding ones of the vane button sockets 100, FIG. 5B. It has been found advantageous to perform this step of the method by starting with the vane button on an end or outside vane 56 of the 180-degree array of vanes and the socket 100 adjacent the corresponding one of the planar ends 92A,B and 98A,B of the shroud ring segments and to then proceed sequentially to the other of the outside vanes and corresponding vane button sockets. Then, the forces squeezing the planar ends of the shroud ring segments together are released, as by unscrewing a turnbuckle, to permit the segments to spring back to their true 180-degree arc shapes, FIG. 5C. In that position, the shroud ring segments are captured on the stator vane buttons due to the aforesaid spoke-like orientations of the vanes.

After the shroud ring segments are assembled on the stator vanes, the bushings 74 are installed over the pivot shafts of the respective stator vanes and seated in the radial bores 70. The bushings are retained on the upper and lower case halves by the washers 80 and the nuts 82. In the final step, performed after the rotor is positioned between the upper and lower case halves, the upper and lower case halves are bolted together at the flanges 22A,26A and 2B,26B.

The embodiments of the invention in which an exclusive property or privilege is claimed are defined as follows:

1. A method of making an annular stage of variable geometry stator vanes on a case of an axial flow compressor, said case being split in a horizontal center-plane thereof a first case half and a second case abutting in said horizontal center-plane at respective longitudinal edges thereof and each of said stator vanes having a pivot shaft at one end and a vane button at the other end, said method comprising the steps of:

forming on each of said first and said second case halves a 180-degree array of a plurality of radial bores in a plane perpendicular to a longitudinal axis of said compressor case, inserting each of said vane pivot shafts loosely into a respective one of said radial bores, forming a first unitary 180-degree arc shroud ring segment having a first planar end and a second planar end and a plurality of vane button sockets in an outer surface thereof equal in number to the number of said stator vanes in said 180-degree array on said first case half, forming a second unitary 180-degree arc shroud ring segment having a first planar end and a second planar end and a plurality of vane button sockets in an outer surface thereof equal in number to the number of said stator vanes in said 180-degree array on said second case half, maintaining each of said first and said second shroud segments in a pinched condition achieved by resiliently deflecting said first and said second planar ends toward each other, fitting said first shroud ring segment on said 180-degree array of stator vanes on said first case half by inserting said vane buttons thereof into respective ones of said vane button sockets on said first shroud ring segment, fitting said second shroud ring segment on said 180-degree array of stator vanes on said second case half by inserting said vane buttons thereof into respective ones of said vane button sockets on said second shroud ring segment, releasing each of said first and said second shroud ring segments from said pinched condition, inserting a bushing between each of said stator vane pivot shafts and the corresponding one of said radial bores to rotatably mount each of said stator vanes on respective ones of said first and said second case halves, and joining said first and said second case halves at said longitudinal edges thereof.

2. The method recited in claim 1 wherein the steps of fitting said first and second shroud ring segments on said 180-degree arrays of stator vanes on said first and said second case halves includes the steps of inserting said vane button of an end one of stator vanes in said 180-degree array of stator vanes on said first case half into a corresponding end one of said vane button sockets adjacent said first planar end of said first shroud ring segment and proceeding sequentially to said one of said vane button sockets adjacent said second planar end of said first shroud ring segment, and inserting said vane button of an end one of stator vanes in said 180-degree array of stator vanes on said second case half into a corresponding end one of said vane button sockets adjacent said first planar end of said second shroud ring segment and proceeding sequentially to said one of said vane button sockets adjacent said second planar end of said second shroud ring segment.

3. In a split-case axial flow compressor having a case including a first case half having a pair of longitudinal edges and a second case half having a pair of longitudinal edges abutting respective ones of said longitudinal edges of said first case half in a horizontal center-plane of said case, a stator vane stage comprising means defining a plurality of radial bores in each of said first and said second case halves in a plane perpendicular to a longitudinal axis of said case and arrayed symmetrically between said longitudinal edges of the corresponding ones of said first and said second case halves, a plurality of stator vanes each having a pivot shaft at a first end thereof loosely received in a respective one of said radial bores in said upper and said lower case halves and a cylindrical vane button at a second end thereof, a plurality of bushings interposed between each of said stator vane pivot shafts and the corresponding one of said radial bores whereby each of said stator vanes is supported on a corresponding one of said first and said second case halves for rotation about a radial axis of said case, a first unitary 180-degree arc shroud ring segment having an outer surface with a plurality of cylindrical bores therein symmetrically spaced between a pair of planar ends of said first shroud ring segment and rotatably receiving a corresponding one of said vane buttons on said stator vanes on said first case half, and a second unitary 180-degree arc shroud ring segment having an outer surface with a plurality of cylindrical bores therein symmetrically spaced between a pair of planar ends of said second shroud ring segment and rotatably receiving a corresponding one of said vane buttons on said stator vanes on said second case half.

* * * * *